US007220193B2

(12) United States Patent
Watanabe

(10) Patent No.: US 7,220,193 B2
(45) Date of Patent: May 22, 2007

(54) GOLF BALL

(75) Inventor: Hideo Watanabe, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 10/918,690

(22) Filed: Aug. 16, 2004

(65) Prior Publication Data

US 2006/0035724 A1 Feb. 16, 2006

(51) Int. Cl.
*A63B 37/12* (2006.01)

(52) U.S. Cl. ..... 473/378

(58) Field of Classification Search ..... 473/377, 473/378

See application file for complete search history.

(56) References Cited

U.S. PATENT DOCUMENTS

| | | | | |
|---|---|---|---|---|
| 5,209,485 | A | 5/1993 | Nesbitt et al. | |
| 5,273,287 | A | 12/1993 | Molitor et al. | |
| 5,433,447 | A | 7/1995 | Pocklington | |
| 5,470,075 | A | 11/1995 | Nesbitt et al. | |
| 5,482,286 | A | 1/1996 | Molitor et al. | |
| 5,503,397 | A | 4/1996 | Molitor et al. | |
| 5,507,493 | A | 4/1996 | Sullivan et al. | |
| 5,569,100 | A | 10/1996 | Molitor et al. | |
| 5,588,924 | A | 12/1996 | Sullivan et al. | |
| 5,601,503 | A | 2/1997 | Yamagishi et al. | |
| 5,609,532 | A | 3/1997 | Chikaraishi | |
| 5,720,675 | A | 2/1998 | Shimosaka et al. | |
| 5,738,597 | A | 4/1998 | Sullivan et al. | |
| 5,833,554 | A | 11/1998 | Sullivan et al. | |
| 5,846,141 | A | 12/1998 | Morgan et al. | |
| 5,971,871 | A | 10/1999 | Sullivan et al. | |
| 6,102,816 | A | 8/2000 | Sullivan et al. | |
| 6,315,683 | B1 | 11/2001 | Yoshida et al. | |
| 6,626,771 | B2 | 9/2003 | Watanabe et al. | |
| 6,672,976 | B2 | 1/2004 | Watanabe et al. | |
| 6,688,992 | B2 * | 2/2004 | Takemura et al. | 473/378 |
| 2001/0031673 | A1 * | 10/2001 | Watanabe | 473/378 |
| 2001/0055998 | A1 * | 12/2001 | Watanabe | 473/383 |
| 2002/0099120 | A1 * | 7/2002 | Takesue et al. | 524/394 |

FOREIGN PATENT DOCUMENTS

| | | | |
|---|---|---|---|
| JP | 11-35633 | A | 2/1999 |
| JP | 11-164912 | A | 6/1999 |
| JP | 2002-293996 | A | 10/2002 |

* cited by examiner

*Primary Examiner*—Raeann Trimiew
(74) *Attorney, Agent, or Firm*—Sughrue Mion, PLLC

(57) ABSTRACT

The invention provides a golf ball comprising a core and a cover of one or more layers, characterized in that the golf ball has an outer diameter of 43.0–45.0 mm and an initial velocity of at least 77.5 m/s measured by the USGA rotary drum initial velocity instrument approved by R&A. The golf ball minimizes the difference in travel distance with a driver (W#1) between high-head speed golfers and low-head speed golfers.

3 Claims, No Drawings

GOLF BALL

BACKGROUND OF THE INVENTION

This invention relates to a golf ball which reduces the difference in travel distance with a driver (W#1) between high-head speed golfers and low-head speed golfers, as compared with prior art golf balls.

A number of golf balls having a larger outer diameter were proposed in the prior art. Such golf balls are known, for example, from U.S. Pat. No. 5,209,485, U.S. Pat. No. 5,273,287, U.S. Pat. No. 5,470,075, U.S. Pat. No. 5,482,286, U.S. Pat. No. 5,503,397, U.S. Pat. No. 5,507,493, U.S. Pat. No. 5,569,100, U.S. Pat. No. 5,588,924, U.S. Pat. No. 5,738,597, U.S. Pat. No. 5,833,554, U.S. Pat. No. 5,971,871, U.S. Pat. No. 6,102,816, U.S. Pat. No. 5,433,447, U.S. Pat. No. 6,315,683, U.S. Pat. No. 5,601,503, U.S. Pat. No. 5,609,532, U.S. Pat. No. 5,720,675, etc.

However, increasing the outer diameter of balls invites a loss of travel distance. This tendency becomes prominent especially in a high head speed region, failing to satisfy those golfers with an ability in that high head speed region, with respect to travel distance.

Also, simply increasing the initial velocity of golf balls permits not only low-head speed (HS) golfers, but also high-head speed golfers to get a gain in travel distance. For example, balls tailored to an initial velocity of at least 77.7 m/s are described in U.S. Pat. No. 5,846,141, U.S. Pat. No. 6,626,771, U.S. Pat. No. 6,672,976, etc.

However, since these golf balls place a focus on the improvement in dimples formed on the ball surface, their improvements in ball outer diameter and structure are insufficient. When two high and low-head speed golfers play with the same golf balls, there arises a significant difference in travel distance. This becomes a practical disadvantage to the low head speed golfer, achieving no compensation for the handicap. Therefore, if the difference in travel distance between high and low-head speed golfers is reduced to lessen the handicap difference between them, the ball becomes of greater value in use by high and low-head speed golfers.

SUMMARY OF THE INVENTION

The present invention has been made under the above circumstances, and its object is to provide a golf ball which reduces the difference in travel distance with a driver (W#1) between high and low-head speed golfers, as compared with prior art golf balls.

Making extensive investigations to attain the above object, the inventor has discovered that when both the outer diameter and the initial velocity of a ball are simultaneously increased, the resulting ball offers an increased travel distance to low-head speed (HS) golfers and a travel distance substantially equal to that of ordinary golf balls to high-head speed (HS) golfers. Specifically, the inventor has completed the present invention based on the discovery that a golf ball comprising a core and a cover of one or more layers wherein the golf ball is adjusted to an outer diameter in the range of 43.0 to 45.0 mm and an initial velocity of at least 77.5 m/s minimizes the difference in travel distance with a driver (W#1) between high and low-head speed golfers.

Accordingly, the present invention provides a golf ball as set forth below.

[1] A golf ball comprising a core and a cover of one or more layers, characterized in that said golf ball has an outer diameter of 43.0 to 45.0 mm and an initial velocity of at least 77.5 m/s measured by the USGA rotary drum initial velocity instrument approved by R&A.

[2] The golf ball of [1], wherein the value A obtained by dividing the ball initial velocity (m/s) by the ball outer diameter (mm) is in the range $1.78 \leqq A \leqq 1.80$.

[3] The golf ball of [1], wherein said ball has a weight of 45.0 to 45.9 g, and said core at its center has a Shore D hardness of 30 to 50.

[4] The golf ball of [1], wherein at least one layer of said cover is a mixture comprising as essential components, 100 parts by weight of a resin component comprising, in admixture, a base resin comprising, in admixture, (a) an olefin-unsaturated carboxylic acid binary random copolymer and/or a metal ion-neutralized product of an olefin-unsaturated carboxylic acid binary random copolymer and (b) an olefin-unsaturated carboxylic acid-unsaturated carboxylic acid ester ternary random copolymer and/or a metal ion-neutralized product of an olefin-unsaturated carboxylic acid-unsaturated carboxylic acid ester ternary random copolymer, in a weight ratio between 100:0 and 25:75, and (e) a non-ionomeric thermoplastic elastomer in a weight ratio between 100:0 and 50:50, (c) 5 to 80 parts by weight of a fatty acid having a molecular weight of 280 to 1,500 or derivative thereof, and (d) 0.1 to 10 parts by weight of a basic inorganic metal compound.

[5] The golf ball of [1], wherein said non-ionomeric thermoplastic elastomer (e) is an olefinic thermoplastic elastomer comprising crystalline polyethylene blocks as hard segments.

[6] The golf ball of [1], wherein said cover is made of a material having organic short fibers dispersed and compounded therein.

DETAILED DESCRIPTION OF THE INVENTION

Now the present invention is described in detail.

The golf ball of the invention comprising a core and a cover of one or more layers is characterized in that the golf ball has an outer diameter of 43.0 to 45.0 mm and an initial velocity of at least 77.5 m/s measured by the USGA rotary drum initial velocity instrument approved by R&A.

The outer diameter of the ball is adjusted to between 43 mm and 45 mm, preferably between 43.2 mm and 44 mm, and more preferably between 43.4 mm and 43.8 mm. With too large a ball outer diameter, a desired travel distance may not be acquired. Inversely, with too small a ball outer diameter, the ball will travel too long a distance when hit in a high-head speed (HS) region of at least 40 m/s, failing to restrain the supremacy in travel distance of high-head speed golfers.

Also the ball may be formed to a weight of 45.0 to 45.93 g, preferably 45.2 to 45.7 g. Too light a ball weight may fail to provide a satisfactory travel distance in the high-head speed region. With too heavy a ball weight, the ball will travel too long a distance when hit in the high-head speed region, making it difficult to attain the object of the invention.

The initial velocity of the ball is adjusted to at least 77.5 m/s, preferably at least 77.72 m/s, and more preferably at least 78.0 m/s. Too low a ball initial velocity, the ball may fail to travel the desired distance in the overall head speed range.

It is noted that the initial velocity is measured using the same type of initial velocity instrument as/the USGA rotary drum initial velocity instrument approved by R&A. The ball is conditioned at a temperature of 23±1° C. for at least 3 hours and tested in a chamber at room temperature of 23±2° C. The ball is hit with a head having a striking mass of 250 pounds (113.4 kg) at a hitting speed of 143.8 ft/s (43.83 m/s). One dozen of balls are hit each four times, and the time of passage across a distance of 6.28 feet (1.91 m) is measured, from which the initial velocity is computed. This cycle is completed within about 15 minutes.

Also, the value A obtained by dividing the ball initial velocity (m/s) by the ball outer diameter (mm) is preferably in the range $1.78 \leqq A \leqq 1.80$ for striking a balance between the ball initial velocity and the ball outer diameter. If the value A is too small, a satisfactory travel distance may not be obtained. If the value A is too large, the ball will travel too long a distance, sometimes making it difficult to restrain the travel distance, especially by high-head speed players.

Next, the core used herein is described.

The core may be formed, for example, of a rubber composition comprising a co-crosslinking agent, an organic peroxide, an inert filler, an organosulfur compound and the like. As the base rubber of this rubber composition, polybutadiene is preferably used.

The polybutadiene as the rubber component desirably has a cis-1,4 unit content on the polymer chain of at least 60 wt %, preferably at least 80 wt %, more preferably at least 90 wt %, and most preferably at least 95 wt %. Too low a cis-1,4 unit content in the molecule may lead to a lower resilience.

Moreover, the polybutadiene has a 1,2-vinyl unit content on the polymer chain of typically not more than 2%, preferably not more than 1.7%, and even more preferably not more than 1.5%. Too high a 1,2-vinyl unit content may lead to a lower resilience.

To obtain a molded and vulcanized rubber composition of good resilience, the polybutadiene used herein is preferably synthesized with a rare-earth catalyst or a Group VIII metal compound catalyst. Polybutadiene synthesized with a rare-earth catalyst is especially preferred.

Such rare-earth catalysts are not subject to any particular limitation. Exemplary rare-earth catalysts include those made up of a combination of a lanthanide series rare-earth compound with an organoaluminum compound, an alumoxane, a halogen-bearing compound and an optional Lewis base.

Examples of suitable lanthanide series rare-earth compounds include halides, carboxylates, alcoholates, thioalcoholates and amides of atomic number 57 to 71 metals.

The use of a neodymium catalyst in which a neodymium compound serves as the lanthanide series rare-earth compound is advantageous because it enables a polybutadiene rubber having a high cis-1,4 unit content and a low 1,2-vinyl unit content to be obtained at an excellent polymerization activity. Preferred examples of such rare-earth catalysts include those mentioned in JP-A 11-35633, JP-A 11-164912 and JP-A 2002-293996.

In the rubber component, the polybutadiene synthesized with a lanthanide series rare-earth compound catalyst is preferably contained in an amount of at least 10% by weight, preferably at least 20% by weight, more preferably at least 40% by weight for improving resilience.

Rubber components other than the above-described polybutadiene may be included in the base rubber, insofar as the objects of the invention are not impaired. Examples of such additional rubber components that may be used include polybutadienes other than the above-described polybutadiene, and other diene rubbers, such as styrene-butadiene rubbers, natural rubbers, isoprene rubbers and ethylene-propylene-diene rubbers.

Examples of the co-crosslinking agent are unsaturated carboxylic acids and metal salts of unsaturated carboxylic acids.

Examples of suitable unsaturated carboxylic acids include acrylic acid, methacrylic acid, maleic acid and fumaric acid. Acrylic acid and methacrylic acid are especially preferred.

Examples of suitable unsaturated carboxylic acid metal salts include, but are not limited to, the above unsaturated carboxylic acids which are neutralized with desired metal ions. Zinc, magnesium and other metal salts of methacrylic acid, acrylic acid and the like are illustrative, with zinc acrylate being especially preferred.

The amount of the unsaturated carboxylic acid and/or metal salt thereof is typically at least 10 parts, preferably at least 15 parts, more preferably at least 20 parts by weight, and as the upper limit, typically not more than 60 parts, preferably not more than 50 parts, more preferably not more than 45 parts, most preferably not more than 40 parts by weight, per 100 parts by weight of the base rubber. Too much amounts may make the core too hard, giving an unacceptable feel upon impact. Too little amounts may lead to a loss of resilience.

The organic peroxides may be commercially available products, such as Percumyl D (by NOF Corporation), Perhexa 3M (by NOF Corporation) and Luperco 231XL (by Atochem Co.). They may be used alone or in admixture of any.

The amount of organic peroxide is typically at least 0.1 part, preferably at least 0.3 part, more preferably at least 0.5 part, and most preferably at least 0.7 part by weight, and as the upper limit, typically not more than 5 parts, preferably not more than 4 parts, more preferably not more than 3 parts, and most preferably not more than 2 parts by weight, per 100 parts by weight of the base rubber. Too much or too little amounts may fail to achieve a satisfactory feel on impact, durability and resilience.

Preferred examples of suitable inert fillers include zinc oxide, barium sulfate and calcium carbonate. Any one or combinations of two or more fillers may be used.

The amount of inert filler is typically at least 1 part, and preferably at least 5 parts by weight, and as the upper limit, not more than 50 parts, preferably not more than 40 parts, more preferably not more than 30 parts, and most preferably not more than 20 parts by weight, per 100 parts by weight of the base rubber. Too much or too little inert filler may fail to achieve an appropriate weight and good rebound characteristics.

If necessary, the rubber composition may include also an antioxidant, suitable examples of which include such commercial products as Nocrac NS-6 and NS-30 (by Ouchi Shinko Chemical Industry Co., Ltd.), and Yoshinox 425 (by Yoshitomi Pharmaceutical Industries, Ltd.). Any one or combinations of two or more thereof may be used.

The amount of antioxidant is typically at least 0 part, preferably at least 0.05 part, more preferably at least 0.1 part by weight, and as the upper limit, not more than 3 parts, preferably not more than 2 parts, more preferably not more than 1 part, and most preferably not more than 0.5 part by weight, per 100 parts by weight of the base rubber. Too much or too little antioxidant may fail to achieve good rebound characteristics and durability.

It is preferable for the core of the golf ball to include an organosulfur compound so as to enhance the rebound characteristics and increase the initial velocity of the golf ball.

The organosulfur compound is not subject to any particular limitation, provided it is able to enhance the rebound characteristics of the ball. Exemplary organosulfur compounds include thiophenols, thionaphthols, halogenated thiophenols, or metal salts thereof, and polysulfides of 2 to 4 sulfurs. Specific examples include pentachlorothiophenol, pentafluorothiophenol, pentabromothiophenol, p-chlorothiophenol, the zinc salt of pentachlorothiophenol, the zinc salt of pentafluorothiophenol, the zinc salt of pentabromothiophenol, the zinc salt of p-chlorothiophenol, and organosulfur compounds having 2 to 4 sulfurs, such as diphenylpolysulfides, dibenzylpolysulfides, dibenzoylpolysulfides, dibenzothiazoylpolysulfides and dithiobenzoylpolysulfides. Diphenyldisulfide and the zinc salt of pentachlorothiophenol are especially preferred.

It is recommended that the organosulfur compound be included in an amount of typically at least 0.05 part, preferably at least 0.1 part, and more preferably at least 0.2 part by weight, per 100 parts by weight of the base rubber. Too little amounts may fail to fully achieve the effect of improving ball rebound. As the upper limit, the amount of organosulfur compound is typically not more than 3.0 parts, preferably not more than 2.3 parts, and more preferably not more than 2.0 parts by weight, per 100 parts by weight of the base rubber. With too much amounts, it may become least expectable to further enhance the effect of improving the rebound of the ball when hit with a driver (W#1). Also the core may become too soft, detracting from the feel on impact.

The core typically has a diameter of at least 34 mm, and more preferably at least 39 mm, and as the upper limit, not more than 42 mm, and more preferably not more than 40 mm. The core typically has a weight of 30 to 38 g, and more preferably 33 to 36.5 g.

The core has a surface hardness of at least 45, preferably at least 48, and more preferably at least 50, and as the upper limit, up to 61, preferably up to 58, and more preferably up to 56, in Shore D hardness. The core has a center hardness of at least 30, preferably at least 35, and more preferably at least 37, and as the upper limit, up to 50, preferably up to 45, and more preferably up to 42. Lower values of core surface hardness or core center hardness below the range may result in too soft a feel on impact and too poor rebound to travel a desired distance, and sometimes, seriously deteriorated durability to cracking by repeated impact. Higher values of core surface hardness or core center hardness above the range may result in too hard a feel on impact.

The value of core surface hardness minus core center hardness is in a range of at least 5 units, preferably at least 8 units, and more preferably at least 10 units, and as the upper limit, up to 20 units, preferably up to 18 units, and more preferably up to 15 units, in Shore D hardness. If the hardness difference of core surface hardness minus core center hardness is too small, the spin rate when hit with a driver (W#1) may increase, failing to travel a desired distance. Too much a hardness difference of core surface hardness minus core center hardness may result in seriously deteriorated durability to cracking by repeated impact and too low rebound.

It is recommended that the core having a diameter in the above range, when the applied load is increased from an initial load of 10 kgf to a final load of 130 kgf, undergo an amount of compressive deflection or deformation (referred to as "deformation [10–130 kgf]") of at least 2.7 mm, preferably at least 3.2 mm, but not more than 5.0 mm, and preferably not more than 4.5 mm, and most preferably not more than 4.0 mm. Too small a deflection may give the ball a hard feel on impact and excessively increased spin, and result in shorter travel when hit with a driver (W#1) at a low head speed. Too large a deflection may worsen the durability to cracking by repeated impact and provide too low a resilience, resulting in shorter travel.

Described below is the cover in the invention.

In the invention, the material of which the cover is made is preferably a composition comprising a mixture of (A) an ionomer resin comprising (a) an olefin-unsaturated carboxylic acid binary random copolymer and/or a metal ion-neutralized product of an olefin-unsaturated carboxylic acid binary random copolymer and optionally, (b) an olefin-unsaturated carboxylic acid-unsaturated carboxylic acid ester ternary random copolymer and/or a metal ion-neutralized product of an olefin-unsaturated carboxylic acid-unsaturated carboxylic acid ester ternary random copolymer, and (e) a non-ionomeric thermoplastic elastomer.

The olefins in component (a) or (b) are preferably alpha-olefins. Specific examples of alpha-olefins include ethylene, propylene, and 1-butene. Inter alia, ethylene is especially preferred. A mixture of such olefins is also useful.

The unsaturated carboxylic acids in component (a) or (b) are preferably α,β-unsaturated carboxylic acids having 3 to 8 carbon atoms. Specific examples of α,β-unsaturated carboxylic acids having 3 to 8 carbon atoms include acrylic acid, methacrylic acid, ethacrylic acid, itaconic acid, and maleic acid. Inter alia, acrylic acid and methacrylic acid are especially preferred. A mixture of such unsaturated carboxylic acids is also useful.

The unsaturated carboxylic acid esters in component (b) are preferably lower alkyl esters of the foregoing unsaturated carboxylic acids, but not limited thereto. Specific examples include methyl methacrylate, ethyl methacrylate, propyl methacrylate, butyl methacrylate, methyl acrylate, ethyl acrylate, propyl acrylate and butyl acrylate. Butyl acrylate (n-butyl acrylate, i-butyl acrylate) are especially preferred. These unsaturated carboxylic acid esters may be used in a combination of two or more. The unsaturated carboxylic acid esters contribute to an improvement in the flexibility of ionomer resins.

It is noted that in the preparation of the olefin-unsaturated carboxylic acid copolymer or olefin-unsaturated carboxylic acid-unsaturated carboxylic acid ester copolymer, additional monomers may be optionally copolymerized insofar as the objects of the invention are not compromised.

The unsaturated carboxylic acid content within the copolymer is typically at least 4 mol %, preferably at least 6 mol %, more preferably at least 8 mol %, and most preferably at least 10 mol %, and as the upper limit, typically not more than 30 mol %, preferably not more than 20 mol %, more preferably not more than 18 mol %, even more preferably not more than 15 mol %, and most preferably not more than 12 mol %. Too low an unsaturated carboxylic acid content may provide a less stiffness and less resilience, resulting in a golf ball with poor flight performance. Too high an unsaturated carboxylic acid content may lead to insufficient flexibility.

When a copolymer based on olefin and unsaturated carboxylic acid monomers and a copolymer based on olefin, unsaturated carboxylic acid and unsaturated carboxylic acid ester monomers are used in blend, their blending proportion is preferably between 100:0 and 25:75, more preferably between 100:0 and 50:50, in weight ratio. With too much an amount of the copolymer based on olefin, unsaturated carboxylic acid and unsaturated carboxylic acid ester monomers blended, resilience may be insufficient.

The ionomer resin (A) used herein is preferably a product obtained by neutralizing any of the foregoing copolymers with at least one of mono- to trivalent metal ions. Examples of mono- to trivalent metal ions suitable for neutralization include sodium, potassium, lithium, magnesium, calcium, zinc, aluminum, ferrous and ferric ions.

Introduction of such metal ions is achieved, for example, by reacting the foregoing copolymers with hydroxides, methoxides, ethoxides, carbonates, nitrates, formates, acetates, and oxides of mono- to trivalent metals.

The degree of neutralization of carboxylic acid in the copolymer is preferably such that at least 10 mol %, more preferably at least 30 mol % and up to 100 mol %, more preferably up to 90 mol % of carboxylic acid groups in the copolymer are neutralized with metal ions. A lower degree of neutralization may lead to less resilience.

It is well known that blending suitable amounts of ionomer resins containing different mono-, di- or trivalent metal ion species provides an ionomer resin-based layer with a good balance of resilience and durability. A blend of ionomer resins in such a recipe is also preferred for the invention.

Commercial products may be used as the ionomer resin (A). Specifically, commercial products of the metal ion-neutralized product of binary random copolymer based on olefin and unsaturated carboxylic acid monomers include Himilan 1554, 1557, 1601, 1605, 1706 and AM7311 (all products of DuPont-Mitsui Polychemicals Co., Ltd.), Surlyn 7930 (E.I. DuPont de Nemours and Company), and Iotek 3110 and 4200 (EXXONMOBIL CHEMICAL); and commercial products of the metal ion-neutralized product of ternary random copolymer based on olefin, unsaturated carboxylic acid and unsaturated carboxylic acid ester monomers include Himilan 1855, 1856 and AM7316 (all products of DuPont-Mitsui Polychemicals Co., Ltd.), Surlyn 6320, 8320, 9320 and 8120 (all products of E.I. DuPont de. Nemours and Company), and Iotek 7510 and 7520 (all products of EXXONMOBIL CHEMICAL).

Examples of the non-ionomeric thermoplastic elastomers (e) include olefinic thermoplastic elastomers, styrenic thermoplastic elastomers, polyester-based thermoplastic elastomers, urethane-based thermoplastic elastomers and polyamide-based thermoplastic elastomers. These elastomers may be used alone or in admixture of two or more. Inter alia, olefinic thermoplastic elastomers are preferred for compatibility with the ionomer resin.

The olefinic thermoplastic elastomers used herein are not particularly limited as long as they are thermoplastic elastomers composed primarily of olefins. The use of olefinic thermoplastic elastomers having crystalline polyethylene blocks is preferred.

Suitable examples of crystalline polyethylene block-bearing olefinic thermoplastic elastomers include those having hard segments composed of crystalline polyethylene blocks (E) or crystalline polyethylene blocks (E) in combination with crystalline polystyrene blocks (S), and having soft segments composed of a relatively random copolymer (EB) of ethylene and butylene. The use of block copolymers having a molecular structure with a hard segment at one or both ends, such as an E-EB, E-EB-E and E-EB-S structure, is especially preferred.

These olefinic thermoplastic elastomers can be prepared by the hydrogenation of a polybutadiene or a styrene-butadiene copolymer.

The polybutadiene or styrene-butadiene copolymer used in hydrogenation is preferably a polybutadiene in which the butadiene structure contains 1,4 polymer blocks which are 95 to 100 wt % composed of 1,4 units, and the overall butadiene structure has a 1,4 unit content of 50 to 100 wt %, and most preferably 80 to 100 wt %. That is, the use of a polybutadiene having a 1,4 unit content of 50 to 100 wt %, and especially 80 to 100 wt %, and in which 95 to 100 wt % of the 1,4 units are included within blocks is preferred.

It is especially preferable for olefinic thermoplastic elastomers having an E-EB-E structure to be prepared by the hydrogenation of a polybutadiene in which both ends of the molecular chain are 1,4 polymerization products rich in 1,4 units, and the center portion of which contains a mixture of 1,4 units and 1,2 units.

The degree of hydrogenation in the polybutadiene or styrene-butadiene copolymer hydrogenation product, expressed as the percent of double bonds in the polybutadiene or styrene-butadiene copolymer that are converted to saturated bonds, is preferably 60 to 100%, and most preferably 90 to 100%. Too low a degree of hydrogenation may lead to deterioration such as gelation in the blending step with the ionomer resin and other components. Moreover, the intermediate layer in the completed golf ball may have problems with durability to impact.

In the block copolymers having a molecular structure with a hard segment at one or both ends, such as an E-EB, E-EB-E or E-EB-S structure, which are preferable for use as the olefinic thermoplastic elastomer, the hard segment content is preferably 10 to 50 wt %. A hard segment content which is too high may result in so low a flexibility as to keep the objects of the invention from being effectively achieved, whereas a hard segment content which is too low may lead to problems with molding of the blend.

The olefinic thermoplastic elastomer described above has a melt index of preferably 0.01 to 15 g/10 min, and most preferably 0.03 to 10 g/10 min, as measured at 230° C. and a test load of 21.2 N. Outside the range, problems such as weld lines, sink marks and short shots may arise during injection molding.

The olefinic thermoplastic elastomer preferably has a surface hardness of 10 to 50. Too low a surface hardness may result in a golf ball with lower durability to repeated impact. Too high a surface hardness may lower the resilience of blends with ionomer resin.

The olefinic thermoplastic elastomer preferably has a number-average molecular weight of 30,000 to 800,000.

Commercial products are available as the crystalline polyethylene block-containing olefinic thermoplastic elastomer described above. Suitable examples include Dynaron 6100P, HSB604 and 4600P (all products of JSR Corporation). The use of Dynaron 6100P is especially preferred herein because it is a block polymer having crystalline olefin blocks at both ends. These olefinic thermoplastic elastomers may be used singly or as mixtures of two or more.

To the non-ionomeric thermoplastic elastomer (e) used herein, polar groups may be grafted so as to improve the compatibility with the ionomer resin (A) in the form of an alkali metal-neutralized ethylene-acrylic acid copolymer. Suitable, non-limiting examples of such polar groups include carboxyl groups, epoxy groups, hydroxyl groups and amino groups.

The non-ionomeric thermoplastic elastomer (e) used herein generally has a Shore D hardness of 20 to 99, preferably 25 to 95, more preferably 30 to 90, and most preferably 35 to 85. Too high a hardness may prevent a sufficient softening effect from being achieved, whereas too low a hardness may lower the flight performance.

In the practice of the invention, components (A) and (e) are used in a mixing ratio (A)/(e) of preferably 100/0 to 50/50 (weight ratio), more preferably 89/11 to 60/40 (weight ratio), and most preferably 85/15 to 65/35 (weight ratio). Too high a content of component (e) may fail to improve the durability of the golf ball.

The cover material described above is preferably arrived at using as a main component a mixture of the base resin composed of a mixture of components (A) and (e), in admixture with (c) a fatty acid or fatty acid derivative having a molecular weight of 280 to 1,500 and (d) a basic inorganic metal compound. As used herein, the "main component" means that a mixture consisting of the above-described components (A) to (d) constitutes at least 50% by weight, preferably at least 70% by weight, most preferably 100% by weight of the entire material of which the cover is made.

Component (c) is a fatty acid or fatty acid derivative having a molecular weight of 280 to 1,500. This component has a very low molecular weight compared with components (A) and (e) and is used to adjust the melt viscosity of the mixture to a suitable level, particularly to help improve flow.

Component (c) has a relatively high content of acid groups (or derivatives thereof) and can prevent an excessive loss of resilience. The molecular weight of the fatty acid or fatty acid derivative as component (c) is at least 280, preferably at least 300, more preferably at least 330, and most preferably at least 360, and as the upper limit, not more than 1,500, preferably not more than 1,000, more preferably not more than 600, and most preferably not more than 500. Too low a molecular weight may detract from heat resistance, whereas too high a molecular weight may fail to improve flow.

Preferred examples of the fatty acid or fatty acid derivative as component (c) include unsaturated fatty acids having a double bond or triple bond on the alkyl group as well as derivatives thereof, and saturated fatty acids in which all the bonds on the alkyl group are single bonds as well as derivatives thereof. It is recommended that the number of carbons on the molecule be typically at least 18, preferably at least 20, more preferably at least 22, and most preferably at least 24, and as the upper limit, not more than 80, preferably not more than 60, more preferably not more than 40, and most preferably not more than 30. Too few carbons may detract from heat resistance and may also make the content of acid groups so high as to diminish the flow-enhancing effect on account of interactions between acid groups in component (c) and acid groups present in the base resin. On the other hand, too many carbons increases the molecular weight, which may also prevent the flow-enhancing effect from being fully achieved.

Specific examples of fatty acids that may be used as component (c) include stearic acid, 12-hydroxystearic acid, behenic acid, oleic acid, linoleic acid, linolenic acid, arachidic acid and lignoceric acid. Of these, stearic acid, arachidic acid, behenic acid and lignoceric acid are preferred. Behenic acid is especially preferred.

Fatty acid derivatives which may be used as component (c) include metallic soaps in which the proton on the acid group of the fatty acid is substituted with a metal ion. Metal ions that may be used in such metallic soaps include $Na^+$, $Li^+$, $Ca^{2+}$, $Mg^{2+}$, $Zn^{2+}$, $Mn^{2+}$, $Al^{3+}$, $Ni^{2+}$, $Fe^{2+}$, $Fe^{3+}$, $Cu^{2+}$, $Sn^{2+}$, $Pb^{2+}$ and $CO^{2+}$. Of these, $Ca^{2+}$, $Mg^{2+}$ and $Zn^{2+}$ are preferred.

Specific examples of fatty acid derivatives that may be used as component (c) include magnesium stearate, calcium stearate, zinc stearate, magnesium 12-hydroxystearate, calcium 12-hydroxystearate, zinc 12-hydroxystearate, magnesium arachidate, calcium arachidate, zinc arachidate, magnesium behenate, calcium behenate, zinc behenate, magnesium lignocerate, calcium lignocerate and zinc lignocerate. Of these, magnesium stearate, calcium stearate, zinc stearate, magnesium arachidate, calcium arachidate, zinc arachidate, magnesium behenate, calcium behenate, zinc behenate, magnesium lignocerate, calcium lignocerate and zinc lignocerate are preferred.

The amount of component (c) relative to the base resin composed of components (A) and (e), expressed as (A+e)/(c), is from 100/5 to 100/80 (weight ratio), preferably from 100/10 to 100/40 (weight ratio), and more preferably from 100/15 to 100/25 (weight ratio). Too little component (c) may lead to a lower melt viscosity and reduced workability, whereas too much may lead to lower durability.

Component (d) is a basic metal compound which can neutralize acid groups in components (A), (e) and (c). If a metallic soap-modified ionomer resin (e.g., the metallic soap-modified ionomer resins mentioned in the above-cited patent publications) is used alone without including component (d), the metallic soap and the un-neutralized acid groups present on the ionomer resin undergo exchange reactions during hot mixing, generating a large amount of fatty acid which gives rise to some problems. Because the fatty acid thus generated has a low thermal stability and can readily vaporize during molding, it may cause molding defects. Moreover, it adheres to the surface of the molded article, which can substantially lower paint film adhesion.

It is recommended that the basic metal compound used as component (d) be one which has a high reactivity with the base resin and thus enables the degree of neutralization of the mixture to be increased without a loss of thermal stability.

Illustrative examples of the metal ions in the basic metal compound as component (d) include $Li^+$, $Na^+$, $K^+$, $Ca^{2+}$, $Mg^{2+}$, $Zn^{2+}$, $Al^{3+}$, $Ni^{2+}$, $Fe^{2+}$, $Fe^{3+}$, $Cu^{2+}$, $Mn^{2+}$, $Sn^{2+}$, $Pb^{2+}$ and $Co^{2+}$. Known basic inorganic fillers containing these metal ions may be used as the basic metal compound. Specific examples include magnesium oxide, magnesium hydroxide, magnesium carbonate, zinc oxide, zinc carbonate, sodium hydroxide, sodium carbonate, calcium oxide, calcium hydroxide, lithium hydroxide and lithium carbonate. A hydroxide or monoxide is recommended. Calcium hydroxide and magnesium oxide, both of which have a high reactivity with the base resin, are preferred. Calcium hydroxide is especially preferred.

The amount of component (d) relative to the base resin composed of components (A) and (e), expressed as (A+e)/(d), is from 100/0.1 to 100/10 (weight ratio), preferably from 100/0.5 to 100/8 (weight ratio), and more preferably from 100/1 to 100/6 (weight ratio). With too little component (d), no improvements in thermal stability and resilience may be observable. Too much instead may lower the heat resistance of the golf ball-forming material due to the presence of excess basic metal compound.

In the cover material, various additives may be compounded if necessary. Suitable additives which can be added herein include pigments, dispersants, antioxidants, UV absorbers and photo-stabilizers. More specific examples of additives are inorganic fillers such as zinc oxide, barium sulfate and titanium dioxide.

The cover material should preferably have a melt flow rate which is adjusted to ensure flow properties that are particularly suitable for injection molding and thus improve moldability. Specifically, it is recommended that the melt flow rate (MFR), as measured according to JIS-K7210 at a temperature of 190° C. and under a load of 21.18 N (2.16 kgf), be set to typically at least 0.5 dg/min, preferably at least 1 dg/min, more preferably at least 1.5 dg/min, and even more preferably at least 2 dg/min, and as the upper limit, typically not more than 20 dg/min, preferably not more than 10 dg/min, more preferably not more than 5 dg/min, and most preferably not more than 3 dg/min. Too large or small a melt flow rate may result in a marked decline in processability.

In the cover material, organic short fibers may be compounded for insuring sufficient durability to repeated impact. The organic short fibers used are preferably made of a binary copolymer consisting of polyolefin and polyamide components.

For the polyolefin component, use may be made of low-density polyethylene (LDPE), high-density polyethylene (HDPE), polypropylene, polystyrene and the like. Of these, polyethylene, especially low-density polyethylene having high crystallinity is preferred.

For the polyamide component, use may be made of nylon 6, nylon 66, nylon 11, nylon 12, nylon 610, nylon 612, copolymerized nylon, nylon MXD6, nylon 46, aramid, polyamide-imide, polyimide and the like. Nylon 6 is preferred from a balance of physical properties and cost. The polyamide component preferably takes the form of fibers, with nylon fibers being especially preferred. It is preferred that the nylon fibers have an average diameter of up to 10 μm, more preferably up to 5 μm, even more preferably up to 1 μm, but at least 0.01 μm because better reinforcement effects are developed for a certain amount blended. It is noted that the average diameter is a measurement from observation of a sample cross-section under a transmission electron microscope.

The preferred form of binary copolymer is a crystalline polyolefin component bound to surfaces of nylon fibers. As used herein, the term "bound" means that the polyamide and polyolefin components are graft linked by adding a binder. The binders used herein include silane coupling agents, titanate coupling agents, unsaturated carboxylic acids, unsaturated carboxylic acid derivatives, organic peroxides and the like.

In the binary copolymer, polyolefin and polyamide components are preferably blended in a weight ratio between 25/75 and 95/5, more preferably between 30/70 and 90/10, and even more preferably between 40/60 and 75/25. Too little polyamide component fails to exert sufficient reinforcing effects. Too much polyamide component makes it difficult to mix with the base resin during kneading on a twin screw extruder or the like.

Also, the base resin and the binary copolymer (organic short fibers) are preferably blended in a weight ratio between 100/0.1 and 100/50, more preferably between 100/1 and 100/40, even more preferably between 100/2 and 100/30. Too less a blending amount fails to exert sufficient effects. Too much a blending amount interferes with kneading or molding into a golf ball cover.

The temperature at which the base resin and the binary copolymer are kneaded is preferably equal to or higher than the melting point of the polyolefin component, more preferably at least 10° C. higher than the melting point of polyolefin component, and equal to or lower than the melting point of the polyamide component, more preferably at least 10° C. lower than the melting point of polyamide component, in order to maintain the shape of polyamide component as intact as possible. However, the kneading temperature is not necessarily limited to this range.

The cover has a hardness of typically at least 55, preferably at least 58, more preferably at least 60, and as the upper limit, typically not more than 70, preferably not more than 67, more preferably not more than 65, in Shore D hardness. Too low a cover hardness may lead to a more spin rate and a less resilience, failing to provide a desired travel distance. Too high a cover hardness may lead to a hard feel on impact and detract from durability to cracking by repeated impact and scuff resistance. It is noted that the Shore D hardness of the cover is measured by a type D durometer according to ASTM D2240.

The gage of the cover has an upper limit of 2.5 mm, preferably 2.2 mm, and more preferably 2.1 mm. Above the upper limit, the rebound may become too low and the feel on impact become too hard. The gage of the cover has a lower limit of 1.2 mm, preferably 1.5 mm, and more preferably 1.7 mm. A gage below the lower limit may make it difficult to mold the cover around the core and detract from durability to cracking by repeated impact In the invention, the cover may be a single layer or a multilayer cover of two or more layers. For the formation of the cover, there may be employed well-known methods including a method of direct injection molding on the core, and a method of preforming a pair of hemispherical half cups and encasing the core within the cups, followed by molding under heat and pressure.

The thus obtained golf ball may be formed with dimples on the cover surface in accordance with any conventional method. Once the dimples are formed, the ball surface may be administered finishing operations including buffing, painting and stamping.

EXAMPLE

Examples and comparative examples are given below for illustrating the invention, but the invention is not limited thereby.

Examples and Comparative Examples

Solid cores in Examples and Comparative Examples were prepared in accordance with the core formulation and vulcanization procedure shown in Table 1. The surface hardness and center hardness of the solid core of each example were determined in Shore D hardness according to ASTM D-2240.

TABLE 1

| | | Example | | | Comparative Example | | |
|---|---|---|---|---|---|---|---|
| | | 1 | 2 | 3 | 1 | 2 | 3 |
| Core formulation (pbw) | Polybutadiene A *1 | 100 | 100 | 50 | 0 | 0 | 100 |
| | Polybutadiene B *2 | 0 | 0 | 50 | 100 | 100 | 0 |
| | Zinc acrylate | 30.5 | 32.0 | 26.5 | 25.5 | 25.5 | 30.5 |
| | Organic peroxide (1) *3 | 0.3 | 0.3 | 0.6 | 0.6 | 0.6 | 0.3 |
| | Organic peroxide (2) *4 | 0.3 | 0.3 | 0.6 | 0.6 | 0.6 | 0.3 |
| | Antioxidant *5 | 0.1 | 0.1 | 0.1 | 0.1 | 0.1 | 0.1 |
| | Zinc oxide | 5.2 | 5.0 | 7.5 | 8.6 | 23.4 | 20.8 |
| | Zinc salt of pentachlorothiophenol | 1 | 1 | 1 | 0 | 0 | 1 |

TABLE 1-continued

| | | Example | | | Comparative Example | | |
|---|---|---|---|---|---|---|---|
| | | 1 | 2 | 3 | 1 | 2 | 3 |
| Core hardness | Surface hardness (Shore D) | 51 | 55 | 46 | 51 | 51 | 51 |
| | Center hardness (Shore D) | 39 | 40 | 37 | 39 | 39 | 39 |
| | Hardness difference (Shore D) | 12 | 15 | 9 | 12 | 12 | 12 |
| Vulcanization (temperature/time) | | 155° C./ 15 min | 155° C./ 15 min | 155° C./ 15 min | 155° C./ 15 min | 155° C./ 15 min | 155° C./ 15 min |

Note:
*1 Polybutadiene A: BR730 (Nd catalyst), by JSR Corp.
*2 Polybutadiene B: BR01 (Ni catalyst), by JSR Corp.
*3 Organic peroxide (1): dicumyl peroxide, Percumyl D (trade name, by NOF Corp.)
*4 Organic peroxide (2): 1,1-bis(t-butylperoxy)-3,3,5-trimethyl-cyclohexane, Perhexa 3M-40 (trade name, by NOF Corp.)
*5 Antioxidant: Nocrac NS-6 (trade name, Ouchi Shinko Chemical Industry Co., Ltd.)

Next, each of the solid cores in Examples and Comparative Examples was enclosed with a cover made of the cover resin composition of formulation A shown in Table 2 having a predetermined gage, completing a two-piece solid golf ball. These balls were determined for flight performance and playability by the following tests. The results are shown in Table 3.

TABLE 2

| Components (pbw) | A |
|---|---|
| Himilan 1706 *1 | 50 |
| Himilan 1605 *2 | 50 |
| Behenic acid *3 | 20 |
| Calcium hydroxide *4 | 2.5 |
| Titanium oxide | 3 |
| Polyolefin/polyamide binary copolymer *5 | 5 |

Note:
*1 ionomer resin, by Dupont-Mitsui Polychemicals Co., Ltd., Zn-neutralized ionomer
*2 ionomer resin, by Dupont-Mitsui Polychemicals Co., Ltd., Na-neutralized ionomer
*3 NAA222-S beads, by NOF Corp.
*4 CLS-B, by Shiraishi Kogyo Co., Ltd.
*5 LA0010, by Daiwa Polymer Co., Ltd., polyolefin (low density polyethylene)/polyamide (nylon 6) short fibers ratio = 50/50 in weight ratio Flight Performance By using a hitting robot equipped with a club and hitting each ball at a high head speed of HS=45 m/s or a low head speed of HS=35 m/s, a total distance was measured. The total distance was computed as an average of ten balls. The club used at HS=45 m/s was a driver (W#1) Tour Stage X-Drive Type 300 with a loft angle 9°. The club used at HS=35 m/s was a driver (W#1) Tour Stage X-Drive Type 350 with a loft angle 10°.

Head Speed (HS) 45 m/s

Δ: total distance is 232 m or longer (more travel than ordinary balls)

○: total distance is from 226 m to less than 232 m (approximately equal travel to ordinary balls)

X: total distance is less than 226 m (less travel than ordinary balls)

Head Speed (HS) 35 m/s

○:1 total distance is 154 m or longer (more travel than ordinary balls)

Δ: total distance is from 152 m to less than 154 m (approximately equal travel to ordinary balls)

X: total distance is less than 152 m (less travel than ordinary balls)

Difference in Travel Distance

The total distance at HS=45 m/s minus the total distance at HS=35 m/s was computed.

○: total distance difference is within 75 m

×: total distance difference is 76 m or more

Ease of Aim

Addressing the ball, ten amateur golfers held a club in position for tee or second shots. It was examined whether they felt easy to aim at the ball or sure to hit the ball.

○: at least 7 of ten golfers felt easy to aim or sure to hit

Δ: at least 7 of ten golfers felt ordinary

TABLE 3

| | | Example | | | Comparative Example | | |
|---|---|---|---|---|---|---|---|
| | | 1 | 2 | 3 | 1 | 2 | 3 |
| Cover | Material | A | A | A | A | A | A |
| | Shore D hardness | 63 | 63 | 63 | 63 | 63 | 63 |
| | Gage (mm) | 2.0 | 2.0 | 2.0 | 2.0 | 2.0 | 2.0 |
| Core | Outer diameter (mm) | 39.6 | 39.6 | 39.6 | 39.6 | 38.7 | 38.7 |
| | Weight (g) | 35.1 | 35.2 | 35.2 | 35.2 | 35.6 | 35.6 |
| | Hardness [10–130 kgf] (mm) | 3.5 | 3.2 | 4.0 | 3.5 | 3.5 | 3.5 |
| Ball | Outer diameter (mm) | 43.6 | 43.6 | 43.6 | 43.6 | 42.7 | 42.7 |
| | Weight (g) | 45.6 | 45.7 | 45.7 | 45.7 | 45.7 | 45.7 |
| | Hardness [10–130 kgf] (mm) | 2.9 | 2.6 | 3.3 | 2.9 | 2.9 | 2.9 |
| | Initial velocity (m/s) | 78.1 | 78.2 | 77.8 | 77.2 | 77.2 | 78.1 |
| | Initial velocity (m/s)/ outer diameter (mm) | 1.79 | 1.79 | 1.78 | 1.77 | 1.81 | 1.83 |

TABLE 3-continued

| | | | Example | | | Comparative Example | | |
|---|---|---|---|---|---|---|---|---|
| | | | 1 | 2 | 3 | 1 | 2 | 3 |
| Flight performance | HS = 45 m/s | Total (m) | 229.3 | 228.4 | 226.0 | 224.0 | 228.5 | 233.3 |
| | | Rating | ○ | ○ | ○ | x | ○ | Δ |
| | HS = 35 m/s | Total (m) | 154.5 | 155.3 | 155.8 | 151.7 | 152.5 | 155.2 |
| | | Rating | ○ | ○ | ○ | x | Δ | ○ |
| Travel distance difference | total at HS = 45 m/s − total at HS = 35 m/s | | 74.8 | 73.1 | 70.2 | 72.3 | 76.0 | 78.1 |
| | Rating | | ○ | ○ | ○ | ○ | x | x |
| Ease of aim | | | ○ | ○ | ○ | ○ | Δ | Δ |

Note: The initial velocity was measured using the same type of initial velocity instrument as the USGA rotary drum initial velocity instrument approved by R & A.

It is seen from the results in Table 3 that the golf balls of Examples marked a high initial velocity and traveled a satisfactory distance when hit at both high and low head speeds HS=45 m/s and 35 m/s. In contrast, the golf ball of Comparative Example 1 marked a low initial velocity and was shorter in travel distance at both HS=45.m/s and 35 m/s. The golf ball of Comparative Example 2, which has a smaller outer diameter and corresponds to ordinary golf balls, was shorter in travel distance at a low head speed HS=35 m/s. No ease of aim (or sureness to hit) was recognized. The golf ball of Comparative Example 3, which has a smaller outer diameter and corresponds to ordinary golf balls, traveled a longer distance not only at a low head speed, but also at a high head speed, meaning a failure in reducing the difference in travel distance between high and low head speed players. Since the outer diameter is as small as ordinary golf balls, the ball did not appear to be easy to aim or sure to hit.

The invention claimed is:

1. A golf ball comprising a core and a cover of one or more layers, characterized in that said golf ball has an outer diameter of 43.0 to 45.0 mm and an initial velocity of at least 77.5 m/s measured by the USGA rotary drum initial velocity instrument approved by R&A, wherein said core has a surface hardness range of 45 to 61 in Shore D hardness and has a center hardness range of 30 to 50 in Shore D hardness and the value of core surface hardness minus core center hardness is in a range of 5 to 20, wherein at least one layer of said cover is a mixture comprising as essential components, 100 parts by weight of a resin component comprising, in admixture, a base resin comprising, in admixture, (a) an olefin-unsaturated carboxylic acid binary random copolymer and/or a metal ion-neutralized product of an olefin-unsaturated carboxylic acid binary random copolymer and (b) an olefin-unsaturated carboxylic acid-unsaturated carboxylic acid ester ternary random copolymer and/or a metal ion-neutralized product of an olefin-unsaturated carboxylic acid-unsaturated carboxylic acid ester ternary random copolymer, in a weight ratio between 100:0 and 25:75, and (e) a non-ionomeric thermoplastic elastomer in a weight ratio between 100:0 and 50:50, (c) 5 to 80 parts by weight of a fatty acid having a molecular weight of 280 to 1,500 or derivative thereof, and (d) 0.1 to 10 parts by weight of a basic inorganic metal compound.

2. The golf ball of claim 1, wherein said non-ionomeric thermoplastic elastomer (e) is an olefinic thermoplastic elastomer comprising crystalline polyethylene blocks as hard segments.

3. A golf ball comprising a core and a cover of one or more layers, characterized in that said golf ball has an outer diameter of 43.0 to 45.0 mm and an initial velocity of at least 77.5 m/s measured by the USGA rotary drum initial velocity instrument approved by R&A, wherein at least one layer of said cover is a mixture comprising as essential components, 100 parts by weight of a resin component comprising in admixture, a base resin comprising, in admixture, (a) an olefin-unsaturated carboxylic acid binary random copolymer and/or a metal ion-neutralized product of an olefin-unsaturated carboxylic acid binary random copolymer and (b) an olefin-unsaturated carboxylic acid-unsaturated carboxylic acid ester ternary random copolymer and/or a metal ion-neutralized product of an olefin-unsaturated carboxylic acid-unsaturated carboxylic acid ester ternary random copolymer, in a weight ratio between 100:0 and 25:75, and (e) a non-ionomeric thermoplastic elastomer in a weight ratio between 100:0 arid 50:50, (c) 5 to 80 parts by weight of a fatty acid having a molecular weight of 280 to 1,500 or derivative thereof, and (d) 0.1 to 10 parts by weight of a basic inorganic metal compound, wherein said cover is made of a material having organic short fibers dispersed and compounded therein.

* * * * *